US005738911A

United States Patent [19]

Imamura et al.

[11] Patent Number: 5,738,911

[45] Date of Patent: Apr. 14, 1998

[54] PROCESS FOR PRODUCING LIQUID-JET RECORDING HEAD, LIQUID-JET RECORDING HEAD PRODUCED THEREBY, AND LIQUID-JET RECORDING APPARATUS COMPRISING THE HEAD

[75] Inventors: Isao Imamura, Kawasaki; Akihiko Shimomura, Yokohama, both of Japan

[73] Assignee: Canon Kabushiki Kaisha, Tokyo, Japan

[21] Appl. No.: 815,460

[22] Filed: Mar. 11, 1997

[30] Foreign Application Priority Data

Mar. 12, 1996 [JP] Japan ..... 8-054640

[51] Int. Cl.[6] ..... B05D 3/02

[52] U.S. Cl. ..... 427/387; 29/890.1; 347/45

[58] Field of Search ..... 347/1, 45; 422/387; 29/890.1

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 5,451,992 | 9/1995 | Shimomura et al. | 347/45 |
| 5,590,451 | 1/1997 | Katsuumi et al. | 29/890.1 K |

*Primary Examiner*—Michael Lusignan

*Attorney, Agent, or Firm*—Fitzpatrick, Cella, Harper & Scinto

[57] ABSTRACT

A process for producing a liquid-jet recording head comprising a liquid-discharging orifice, a liquid path communicating to the orifice, and a liquid ejecting energy-generating element for generating an energy to be utilized for ejecting the liquid, which comprises the steps of pouring, into the liquid path, a solution containing a perhydropolysilazane represented by the formula (I):

(I)

to allow the solution to attach onto the wall of the liquid path, and after attachment of the solution, heating the solution to form a hydrophilic layer comprising baked perhydropolysilazane on the wall of the liquid path.

5 Claims, 2 Drawing Sheets

PROCESS FOR PRODUCING LIQUID-JET RECORDING HEAD, LIQUID-JET RECORDING HEAD PRODUCED THEREBY, AND LIQUID-JET RECORDING APPARATUS COMPRISING THE HEAD

BACKGROUND OF THE INVENTION

1. Field of the Invention

The present invention relates to a process for producing a liquid-jet recording head for forming recording liquid droplets which are used for an ink-jet recording (liquid-jet recording). The present invention also relates to a liquid-jet recording head produced by the process, and an ink-jet recording apparatus employing the head.

2. Related Background Art

The ink (liquid) to be used for the ink-jet recording (liquid-jet recording) employs a solvent of higher polarity and higher alkalinity in order to dissolve a dye or a pigment having excellent properties in water-resistance, color-developability, fixability and the like. Moreover, the nozzle of the liquid-jet recording head is made finer in order to obtain higher quality of the recorded picture image. Furthermore, the frequency of the ink-ejection from the nozzle liquid path of the head is made higher in order to achieve higher printing speed.

For the finer nozzle and higher frequency of ink ejection, the liquid path of the recording head is required to be improved in ink-refilling properties. For the improvement of the ink-refilling properties, the wettability (hydrophilicity) of the liquid path to the ink should be required to be improved.

Conventionally, the liquid path of the recording heads is formed, for example, by light-curing an activation energy ray-curable resin and carrying out subsequent heat treatment. However, such a material for the liquid path does not necessarily have good ink-wettability since the material is required to have structural strength and ink-resistance. Therefore, the formed liquid path is treated for hydrophilicity to improve the wettability to the ink.

It is necessary to modify the surface of the liquid path before the treatment for hydrophilicity. The method of surface modification includes sand-blasting, etching, plasma-ashing, and UV-ozone treatment. Otherwise, a surface modification layer primer-treated or silane-treated may be provided on the liquid path surface.

However, the sand-blasting treatment physically roughens the surface without radical improvement, and is not applicable to an article of a complicated shape. The etching treatment may cause penetration of an etching liquid into the construction material, giving adverse effects of swelling, cracking, or the like of the material, and the effect of the treatment is not always satisfactory. The plasma-ashing treatment is not applicable to an article of a complicated shape, and requires an expensive apparatus. The UV-ozone treatment is not capable of giving satisfactory effects.

The method for providing the surface modification layer as a coating layer is desirable in view of the surface modification. It can be unsatisfactory in adhesion of the surface modification layer to the underlying material, or insufficient in heat resistance or chemical resistance. Moreover, the formation of the surface modification layer is not suitable for a liquid path of fine structure since the thickness of the coating layer requires at least several microns in view of the mechanical strength and the effect.

SUMMARY OF THE INVENTION

An object of the present invention is to provide a process for producing a liquid-jet recording head comprising a hydrophilic layer provided on the liquid path which is excellent in solvent-resistance, chemical resistance, wettability to ink, and adhesiveness to the underlying material.

Another object of the present invention is to provide a liquid-jet recording head produced by the above process.

Still another object of the present invention is to provide a liquid-jet recording apparatus employing the above recording head.

A further object of the present invention is to provide a process for producing a liquid-jet recording head comprising a liquid-discharging orifice, a liquid path communicating to the orifice, and a liquid ejecting energy-generating element for generating an energy to be utilized for ejecting the liquid, the process comprising the steps of: pouring, into the liquid path, a solution containing a perhydropolysilazane represented by the formula (I):

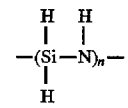

(I)

to allow the solution to attach onto the wall of the liquid path, and after attachment of the solution heating the solution to form a hydrophilic layer comprising baked perhydropolysilazane on the wall of the liquid path; the liquid-jet recording head produced by the above process; and the liquid-jet recording apparatus comprising the above recording head.

DESCRIPTION OF THE PREFERRED EMBODIMENTS

The present invention is described in detail by reference to the drawings.

Figure 2:
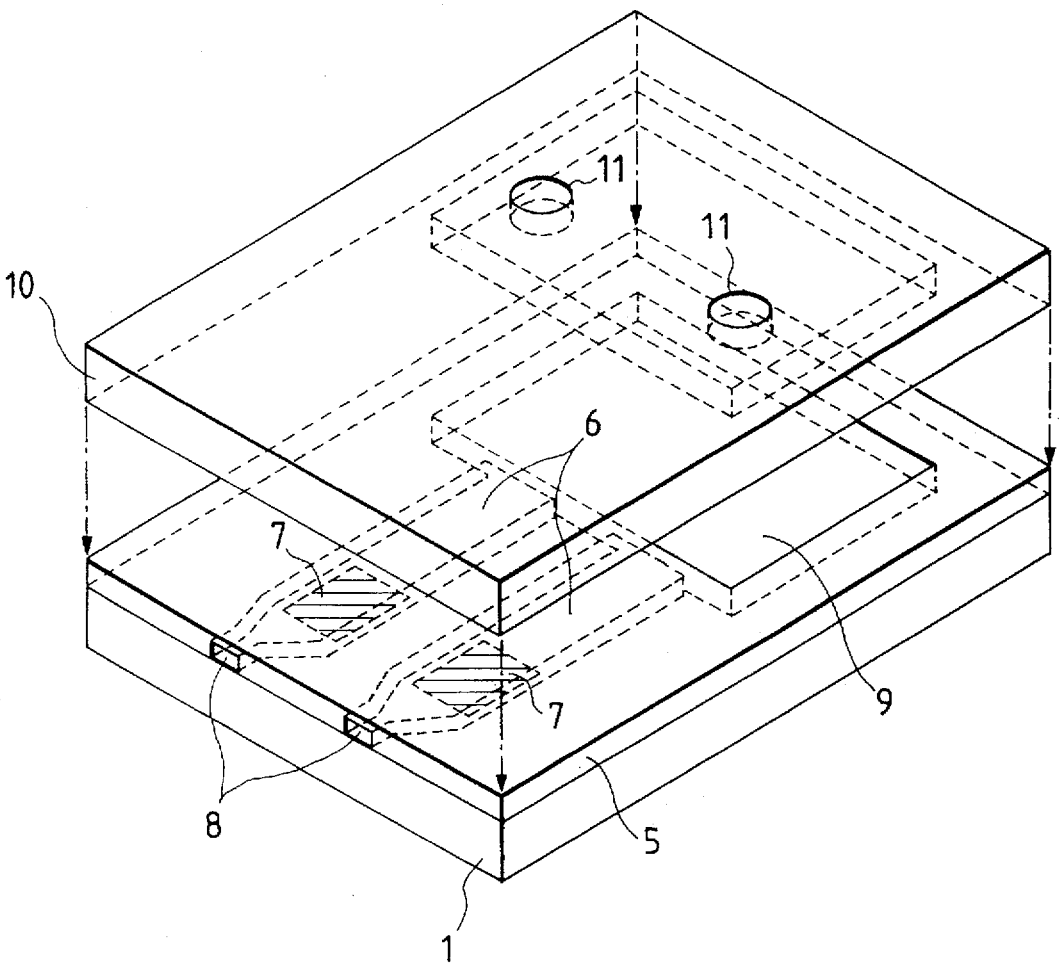
FIG. 2 is a schematic perspective view of a liquid-jet recording head of the present invention.

FIG. 2 is a schematic perspective view of a liquid-jet recording head of the present invention. In FIG. 2, liquid paths 6 communicate respectively with a discharging orifices 8. The liquid flow paths 6 also communicate with a common liquid chamber 9. An ink is fed through ink-feeding openings 11 into the liquid chamber 9 from the outside. A substrate 1 is provided with liquid ejecting energy-generating elements 7 for ejecting the ink. The substrate 1 and a cover plate 10 having the ink-feeding openings 11 are bonded with interposition of a liquid path-constructing material 5 for forming the walls of the liquid paths 6 to form the liquid paths 6.

The cover plate 10 can be omitted by forming the upper walls as well as the side walls of the liquid path from the liquid path-constructing material 5. In this case the ink-feeding openings 11 are formed through the liquid path-constructing material.

In the present invention, a solution of a perhydropolysilazane represented by the formula (I) is poured into the liquid paths of a liquid-jet recording head to attach to the wall surface of the liquid paths, and the solution is baked to form a hydrophilic layer on the wall surface.

According to the present invention, a hydrophilic layer is formed readily in a thickness of as small as several angstroms at a high density with less curing shrinkage. Thereby, a liquid-jet recording head is provided which is capable of responding to high-frequency ink ejection.

The baked layer formed from the perhydropolysilazane by the heating is a dense $SiO_2$ layer, which is excellent in solvent resistance, chemical resistance, and adhesiveness to the liquid path-constructing material. Therefore, a liquid-jet recording head with high reliability is constructed.

Hitherto, $SiO_2$ films are usually formed from a metal alkoxide or the like mainly by a sol-gel method as the conventional method, in which a surface modification layer is formed by dehydrating polycondensation. In contrast thereto, in the present invention, the $SiO_2$ layer is formed by baking the perhydropolysilazane in an air atmosphere to release nitrogen atoms and hydrogen atoms from the perhydropolysilazane and to incorporate oxygen atoms into the molecules. The formed layer has excellent film quality in comparison with the films of the prior art.

The molecular weight of the perhydropolysilazane is preferably in the range of from 600 to 2000 in view of the coating film-forming properties in the production process. The perhydropolysilazane is soluble in most of aromatic hydrocarbon solvents. A solution containing the perhydropolysilazane of the above molecular weight range exhibits excellent characteristics in film formation, and capable of forming a uniform thin film of a thickness of several angstroms on the liquid path surface.

The baking of the perhydropolysilazane coating film is conducted preferably by heating at a temperature ranging from 250° C. to 500° C. for a time ranging from 0.5 to 3 hours.

The present invention is described in more detail by reference to Examples.

EXAMPLE

A liquid-jet recording head was produced by the procedure shown in FIGS. 1A to 1F.

Figure 1A:
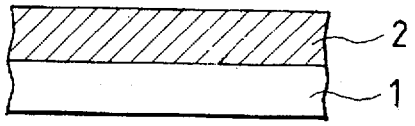
FIGS. 1A, 1B, 1C, 1D, 1E and 1F are sectional views illustrating the production steps of a process for producing a liquid-jet recording head, and the steps are carried out in the named order of FIG. 1A, FIG. 1B, FIG. 1C, FIG. 1D, FIG. 1E, and FIG. 1F.
Figure 1B:
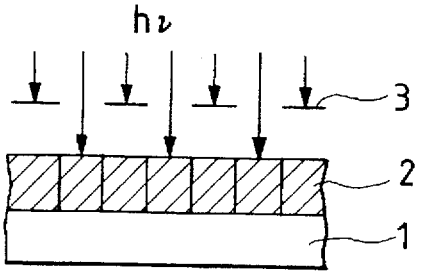
Figure 1C:
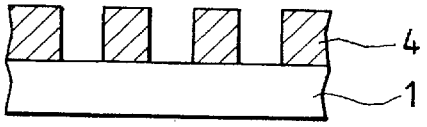

Positive type photoresist AZ-4903 (Hoechst Co.) 2was spin-coated in a thickness of 30 μm on a substrate 1 having an electrothermal conversion member thereon as the liquid ejecting energy-generating element (FIG. 1A). The resist was prebaked at 90° C. for 20 minutes in an oven to form a resist layer 2. This resist layer was exposed to light through a nozzle pattern mask 3 at an irradiation dose of 200 mJ/cm$^2$ by means of a mask aligner PLA-501 (Canon K.K.) (FIG. 1B). The resist layer was developed with an aqueous sodium hydroxide solution (0.75% by weight), and then rinsed with deionized water to form a resist pattern 4 on the substrate 1 (FIG. 1C).

The developed substrate was subjected twice to a series of treatment steps of postbaking at 70° C. for 30 minutes in an oven, full-face light exposure at a dose of 15 mJ/cm$^2$, and degassing under a vacuum of 0.1 mmHg for 30 minutes.

Figure 1D:
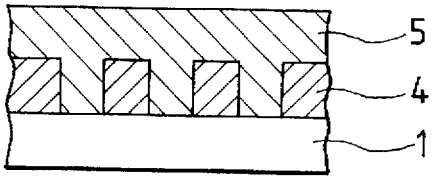
Figure 1E:
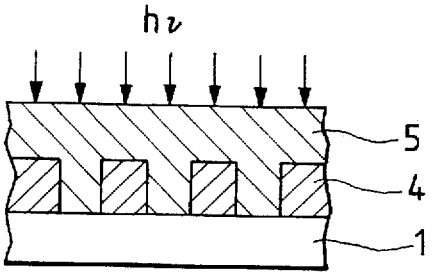

Onto the above substrate, was applied a liquid-path forming material 5 composed of an activation energy-curable resin of Resin Composition 1 shown below (FIG. 1D). The coated substrate was exposed to light from the top at a dose of 8 J/cm$^2$ (FIG. 1E), and subsequently cured thermally at 120° C. for 2 hours.

Resin Composition 1:

| | Parts by weight |
|---|---|
| Adeka Optomer KRM2410 (Asahi Denka Kogyo K.K.) | 75 |
| LS-7970 (Shin-Etsu Chemical Co.) | 25 |
| Silane-coupling agent A-187 (Nippon Unicar Co.) | 5 |
| Adeka Optomer SP-170 (Asahi Denka Kogyo K.K.) | 1.5 |

Figure 1F:
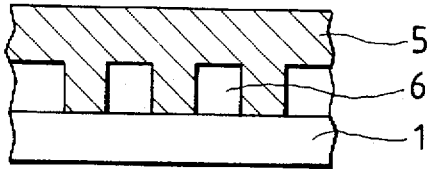

The resist pattern 4 was removed by an aqueous sodium hydroxide solution (3.5% by weight) (FIG. 1F). Then the liquid path 6 was formed by rinsing with deionized water.

Subsequently, a perhydropolysilazane PHPS-1 (Torten 5 K.K., 0.1% in MIBK solution) was poured into the formed liquid path, and excessive perhydropolysilazane was removed by air-blowing. The perhydropolysilazane was dried at 100° C. for one hour, and then cured thermally at 300° C. for one hour to convert it into ceramic and to form a hydrophilicity-imparting layer composed of a baked perhydropolysilazane on the surface of the liquid path. The used perhydropolysilazane had a molecular weight ranging from 600 to 900.

COMPARATIVE EXAMPLE 1

A recording head was produced through the steps of FIGS. 1A to 1F in the same manner as in Example 1 except that the perhydropolysilazane treatment was not conducted.

COMPARATIVE EXAMPLE 2

A baked layer was formed in the same manner as in Example 1 except that OCO Type 2 (Tokyo Ohka Kogyo K.K.) used for the conventional SOG film formation was used in place of the perhydropolysilazane treatment.

TEST EXAMPLE

The recording heads produced in Example and Comparative Examples 1 and 2 were respectively mounted on a liquid-jet recording apparatus to test for character printing. As the results, at the ejection frequency of 3 kHz, the head of Comparative Example 1 caused partly blurring of the printed characters; and the head of Comparative Example 2 did not cause blurring at the early stage of the printing, but came to cause blurring with progression of printing. This is presumably due to hydrophilicity of the liquid path insufficient to a required ink refiling speed.

In contrast thereto, the head of Example did not cause blurring of the printed characters.

As described above, the present invention enables formation of a hydrophilic layer on the liquid path, the hydrophilic layer being denser than conventional ones, and being excellent in chemical resistance, solvent resistance, and heat resistance. Further, the formed hydrophilic layer exhibits high adhesiveness to the underlying layer to improve reliability of the head.

The present invention is effective, in particular, for an ink-jet type recording head and apparatus which conducts recording by ejection of liquid droplets by utilizing thermal energy.

It is preferable to employ the typical structure and the principle of structures disclosed in, for example, U.S. Pat. No. 4,723,129 and U.S. Pat. No. 4,740,796. This system can be adopted in a so-called "On-Demand" type and "Continuous" type structures. In this system particularly of the On-Demand type, an electrothermal conversion member disposed to align to a sheet or a liquid path in which liquid (ink) is held is supplied with at least one drive signal which corresponds to information to be recorded and which enables the temperature of the electrothermal conversion member to be raised higher than a nuclear boiling point, so that thermal energy is generated in the electrothermal conversion member and film boiling is caused to take place on the surface of the recording head which is heated. As a result, bubbles can be respectively formed in liquid (ink) is response to the drive signals. Due to the enlargement and contraction of the bubble, liquid (ink) is discharged through the discharging orifice, so that at least one droplet is formed. In a case where the aforesaid drive signal is made to be a pulse signal, a further satisfactory effect can be obtained in that the bubble can immediately and properly be enlarged/contract and liquid (ink) can be discharged while exhibiting excellent responsibility.

It is preferable to employ a drive signal of the pulse signal type disclosed in U.S. Pat. No. 4,463,359 and U.S. Pat. No. 4,345,262. Furthermore, in a case where conditions for determining the temperature rise ratio on the aforesaid heated surface disclosed in U.S. Pat. No. 4,313,124 are adopted, a further excellent recording operation can be performed.

In addition to the structure (a linear liquid path or a perpendicular liquid path) of the recording head formed by combining the discharging orifices, the liquid path and the electrothermal conversion member as disclosed in the aforesaid specifications, a structure disclosed in U.S. Pat. No. 4,558,333 and U.S. Pat. No. 4,459,600 in which the heated portion is disposed in a bent portion is included in the scope of the present invention.

Furthermore, the present invention can effectively be embodied in a structure in which a common slit is made to be the discharge portion of a plurality of electrothermal conversion members and which is disclosed in Japanese Patent Application Laid-Open No. 59-123670 and a structure in which an opening for absorbing thermal energy pressure wave is formed to align to the discharging orifice and which is disclosed in Japanese Patent Application Laid-Open No. 59-138461.

A full line type recording head having a length which corresonds to the width of the maximum recording medium which can be recorded by the recording apparatus may be a structure capable of realizing the aforesaid length and formed by combining a plurality of recording heads as disclosed in the aforesaid specifications or a structure formed by a integrally formed recording head. The present invention will enable the aforesaid effects to be exhibited further effectively.

In addition, the present invention can also be effectively adapted to a structure having an interchangeable chip type recording head which can be electrically connected to the body of the apparatus or to which ink can be supplied from the body of the apparatus when it is mounted on the body of the apparatus or a cartridge type recording head integrally formed to the recording head.

It is preferable to additionally provide the recording head recovery means and an auxiliar means of the recording apparatus according to the present invention because the effect of the present invention can further be stabled. Specifically, an effect can be obtained in that the recording operation can be stably performed by providing a recording head capping means, a cleaning means, a pressurizing or sucking means, an electrothermal conversion member or another heating device or an auxiliary heating means formed by combining the aforesaid elements and by performing a previous discharge mode in which a discharge is performed individually from the recording operation.

Furthermore, the recording mode of the recording apparatus may be a recording mode for recording only main color such as black. Although a structure may be that formed by integrally forming recording heads or a structure formed by combining a plurality of recording heads, the present invention can significantly effectively be adapted to an apparatus having a recording head of a plurality of colors or at least one full color head arranged to mix colors.

Although the aforesaid embodiments use liquid ink, ink which is solid at room temperature or ink which is softened at room temperature can be used. In the aforesaid ink jet apparatus, the temperature of ink is usually controlled in a range from 30° C. to 70° C. to make the viscosity of ink to be in a stable discharge range and thereby ink which is liquefied in response to a record signal supplied may be used.

Furthermore, ink the temperature rise of which is prevented by positively using the temperature rise due to the thermal energy as energy of state change from the solid state to the liquid state of ink or ink which is solidified when it is allowed to stand in order to prevent the evaporation of ink may be used. That is, ink which is liquefied by thermal energy such as ink liquefied by thermal energy supplied in response to the record signal and discharged as ink droplet or ink which is solidified when it reaches the recording medium can be employed in the present invention. In this case, ink may be, in the form of liquid or solid, held by a recess of a porous sheet or a through hole as disclosed in Japanese Patent Application Laid-Open No. 54-56847 or Japanese Patent Application Laid-Open No. 60-71260 and disposed to confront the electrothermal conversion member. It is most preferable that ink be discharged by the aforesaid film boiling method.

Additionally, the recording apparatus according to the present invention may be used, separately or integrally, as an image output terminal of an information processing apparatus such as word processors and computers, and as copying machines combined with a reader, or a facsimile apparatus having an information transmitting-and-receiving function.

What is claimed is:

1. A process for producing a liquid-jet recording head comprising a liquid-discharging orifice, a liquid path communicating to the orifice, and a liquid ejecting energy-generating element for generating an energy to be utilized for ejecting the liquid, which comprises the steps of:

pouring, into the liquid path, a solution containing a perhydropolysilazane represented by the formula (I):

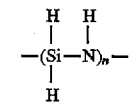

(I)

to allow the solution to attach onto the wall of the liquid path; and after attachment of the solution, heating the solution to form a hydrophilic layer comprising baked perhydropolysilazane on the wall of the liquid path.

2. The process for producing a liquid-jet recording head according to claim 1, wherein the perhydropolysilazane has a molecular weight ranging from 600 to 2000.

3. The process for producing a liquid-jet recording head according to claim 1, wherein heating is conducted at a temperature ranging from 250° C. to 500° C. for a time of 0.5 to 3 hours.

4. A liquid-jet recording head produced by the process set forth in claim 1.

5. A liquid-jet recording apparatus comprising the recording head set forth in claim 4 and a signal supplying apparatus for supplying signals for driving the recording head.

* * * * *

UNITED STATES PATENT AND TRADEMARK OFFICE

CERTIFICATE OF CORRECTION

PATENT NO. : 5,738,911

DATED : April 14, 1998

INVENTOR(S) : ISAO IMAMURA, ET AL.

It is certified that error appears in the above-identified patent and that said Letters Patent is hereby corrected as shown below:

ON THE COVER PAGE:

Item [56] References Cited insert

--FOREIGN PATENT DOCUMENTS--

| | | |
|---|---|---|
| 59-123670 | 7/84 | JAPAN |
| 59-138461 | 8/84 | JAPAN |
| 54-056847 | 5/79 | JAPAN |
| 60-071260 | 4/85 | JAPAN--. |

COLUMN 2:

Line 14, "of:" should read --of--.
Line 45, "a" should be deleted.

COLUMN 3:

Line 44, 2was" should read --2 was--.
Line 62, "substrate," should read --substrate--.

UNITED STATES PATENT AND TRADEMARK OFFICE

CERTIFICATE OF CORRECTION

PATENT NO. : 5,738,911

DATED : April 14, 1998

INVENTOR(S) : ISAO IMAMURA, ET AL.

It is certified that error appears in the above-identified patent and that said Letters Patent is hereby corrected as shown below:

COLUMN 4:

Line 17, "(Torten 5" should read --(Tonen--.
Line 44, "partly" should read --partial--.
Line 48, "refiling" should read --refilling--.
Line 49, "Example" should read --the Example--.

COLUMN 5:

Line 9, "is" should read --in--.
Line 16, "contact" should read --contracted--.
Line 59, "auxiliar" should read --auxiliary--.
Line 61, "stabled," should read --stabilized.--.

COLUMN 6:

Line 15, "ink" should read --ink,--.
Line 19, "of ink" should read --of ink;--.

Signed and Sealed this

Twenty-fifth Day of May, 1999

*Attest:*

Q. TODD DICKINSON

*Attesting Officer*

*Acting Commissioner of Patents and Trademarks*